US010640991B1

(12) United States Patent
Corona et al.

(10) Patent No.: US 10,640,991 B1
(45) Date of Patent: May 5, 2020

(54) WOOD FLOORING ADJUSTMENT AND ASSEMBLY TOOL AND ASSOCIATED USE THEREOF

(71) Applicants: Lazaro Corona, San Bernardino, CA (US); Chris Corona, San Bernardino, CA (US)

(72) Inventors: Lazaro Corona, San Bernardino, CA (US); Chris Corona, San Bernardino, CA (US)

( * ) Notice: Subject to any disclaimer, the term of this patent is extended or adjusted under 35 U.S.C. 154(b) by 165 days.

(21) Appl. No.: 15/798,290

(22) Filed: Oct. 30, 2017

Related U.S. Application Data

(60) Provisional application No. 62/414,010, filed on Oct. 28, 2016.

(51) Int. Cl.

| | |
|---|---|
| ***B66F 3/00*** | (2006.01) |
| ***E04F 21/22*** | (2006.01) |
| ***B66F 19/00*** | (2006.01) |
| *E04F 15/04* | (2006.01) |
| *E04F 15/02* | (2006.01) |

(52) U.S. Cl.
CPC ..... *E04F 21/22* (2013.01); *B66F 19/00* (2013.01); *E04F 15/02038* (2013.01); *E04F 15/04* (2013.01); *E04F 2201/0107* (2013.01)

(58) Field of Classification Search
USPC ..... 254/11, 12, 16, 17, 93 R; 81/46
See application file for complete search history.

(56) References Cited

U.S. PATENT DOCUMENTS

| | | | | |
|---|---|---|---|---|
| 7,451,671 | B2 * | 11/2008 | Coleman, Jr. | E04F 21/22 254/12 |
| 8,708,310 | B2 * | 4/2014 | Edgerly | E04F 21/22 254/11 |
| 2006/0278859 | A1 * | 12/2006 | Fraley | E04F 21/22 254/17 |
| 2008/0191180 | A1 * | 8/2008 | Gaunt | E04F 21/22 254/11 |

* cited by examiner

*Primary Examiner* — Joseph J Hail
*Assistant Examiner* — Shantese L McDonald
(74) *Attorney, Agent, or Firm* — Ashkan Najafi

(57) ABSTRACT

A wood flooring adjustment and assembly tool includes a stationary flat bar having a distal end provided with a downwardly oriented lip, a guide statically attached to a top surface of the flat bar and located proximally of the downwardly oriented lip, a dynamic bar slidably positioned through the guide and linearly reciprocated along the stationary flat bar wherein the dynamic bar has a plate affixed to a distal end thereof, and a lever having a bottom end pivotally positioned at a proximal end of the stationary flat bar and directly abutted against a proximal end of the dynamic bar. Such a lever is pivotal about a fulcrum axis registered orthogonal to the proximal end of the stationary flat bar. The downwardly oriented lip is registered orthogonal to a longitudinal length of the dynamic bar and parallel to the flat bar.

13 Claims, 5 Drawing Sheets

WOOD FLOORING ADJUSTMENT AND ASSEMBLY TOOL AND ASSOCIATED USE THEREOF

CROSS REFERENCE TO RELATED APPLICATIONS

This is a non-provisional patent application that claims the benefit of U.S. provisional patent application No. 62/414,010 filed Oct. 28, 2016, which is incorporated by reference herein in its entirety.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to floor-installation tools and, more particularly, to a manually-operated, wood flooring adjustment and assembly tool for use in the installation of tongue-and-groove, hardwood flooring. Working quickly to ensure that laid flooring boards have a tight fit with no gaps, or damage or marring of the wood, the wood flooring adjustment and assembly tool appeals to anyone who installs hardwood flooring—flooring contractors, all-around handymen, and do-it-yourself householders.

Prior Art

Men tease women about all the shoes they have, and women tease men about all their tools. Just why a woman would need thirty or more pairs of shoes, no one knows. But a man can quite easily justify a heavy steel box—or a footlocker on wheels, or an entire room of the house—devoted to tools. Why? It's simple: without the right tool, you quite often cannot perform the task; or worse, in an effort to complete the task, you use the wrong tool and just make matters worse. As a consequence of this fact, men accumulate tools as they encounter new tasks, purchasing the tool required to complete the job at hand. The tools therefore multiply, and the toolbox gets heavier.

There may be a similar phenomenon at work with regard to women and shoes, but no one has found it. Just as a man buys tools as the need for them arises, so tools are invented in response to need. Before the era of sheetrock walls, for example, no one invented anchor-screws because there was no need for them. The story is much the same for the bewildering variety of tools, fasteners, and other equipment to be found in the trucks or toolboxes of today's men, whether professional contractors or homeowners with a bent for do-it-yourself projects.

One such tool is the subject of this report. The need for this tool arises in the installation of tongue-and-groove hardwood flooring where, once the individual boards have been laid, they must be tightened so that no buckles, spaces, or gaps will occur. Typically, this phase of the work is accomplished by using a crowbar along the junction of the floor and wall, where the floorboards run parallel to the wall;

but this is a time-consuming and tedious process, and often results in disfigurement or marring of the sheetrock wall. The tool to be presented and explored in the course of this report, in contrast, would perform this job neatly, easily, and quickly.

Accordingly, a need remains for wood flooring adjustment and assembly tool in order to overcome at least one aforementioned shortcoming. The exemplary embodiment(s) satisfy such a need by providing a manually-operated, wood flooring adjustment and assembly tool for use in the installation of tongue-and-groove, hardwood flooring that is convenient and easy to use, lightweight yet durable in design, versatile in its applications, and designed for working quickly to ensure that laid flooring boards have a tight fit with no gaps, or damage or marring of the wood, the wood flooring adjustment and assembly tool appeals to anyone who installs hardwood flooring—flooring contractors, all-around handymen, and do-it-yourself householders.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a wood flooring adjustment and assembly tool for use during installation of tongue-and-groove flooring. These and other objects, features, and advantages of the non-limiting exemplary embodiment(s) are provided by a wood flooring adjustment and assembly tool including a stationary flat bar having a distal end provided with a downwardly oriented lip, a guide statically attached to a top surface of the flat bar and located proximally of the downwardly oriented lip, a dynamic bar slidably positioned through the guide and linearly reciprocated along the stationary flat bar wherein the dynamic bar has a plate affixed to a distal end thereof, and a lever having a bottom end pivotally positioned at a proximal end of the stationary flat bar and directly abutted against a proximal end of the dynamic bar. Such a lever is pivotal about a fulcrum axis registered orthogonal to the proximal end of the stationary flat bar. Notably, the downwardly oriented lip is registered orthogonal to a longitudinal length of the dynamic bar and parallel to the flat bar. Advantageously, when the bottom end of the lever is articulated towards the existing wall, the lever exerts a force on the dynamic bar and thereby urges the flat plate towards and against the existing wall such that the downwardly oriented lip catches a leading edge of the existing flooring and exerts an equivalent opposite force against the leading edge of the existing flooring away from the existing wall.

In a non-limiting exemplary embodiment, the stationary flat bar has a substantially smooth top surface and includes a three-sided, U-shaped bracket fixedly mated to the proximal end thereof and abutted against the bottom end of the lever during articulation of the lever.

In a non-limiting exemplary embodiment, the dynamic bar includes a two-side, V-shaped bracket statically coupled to the proximal end thereof.

In a non-limiting exemplary embodiment, the dynamic bar reciprocates along a bi-directional linear path registered substantially parallel to a longitudinal length of the stationary flat bar.

In a non-limiting exemplary embodiment, the plate is oriented orthogonal to the bi-directional linear path.

In a non-limiting exemplary embodiment, the V-shaped bracket extends upwardly and away from the dynamic bar.

In a non-limiting exemplary embodiment, the lever has a linear longitudinal length and is disengaged from the dynamic bar as well as the stationary flat bar during non-operating conditions. Such a lever is oriented perpendicular the stationary flat bar when the dynamic bar is retracted to an equilibrium position during non-operating conditions.

In a non-limiting exemplary embodiment, the dynamic bar lays on top of the stationary flat bar and substantially parallel thereto.

The present disclosure further includes a method of utilizing a wood flooring adjustment and assembly tool during installation of tongue-and-groove flooring. Such a method includes the steps of: providing a stationary flat bar including a distal end having a downwardly oriented lip; providing and statically attaching a guide to a top surface of the flat bar such that the guide is located proximally of the downwardly oriented lip; and providing and slidably positioning a dynamic bar through the guide such that the dynamic bar is linearly reciprocated along the stationary flat bar wherein the dynamic bar has a plate affixed to a distal end thereof. Notably, the downwardly oriented lip is registered orthogonal to a longitudinal length of the dynamic bar and parallel to the flat bar.

The method further includes the steps of: providing and pivotally positioning a bottom end of a lever at a proximal end of the stationary flat bar such that the bottom end is directly abutted against a proximal end of the dynamic bar; pivoting the lever about a fulcrum axis registered orthogonal to the proximal end of the stationary flat bar such that the bottom end of the lever is articulated towards the existing wall; and the lever exerting a force on the dynamic bar thereby urging the flat plate towards and against the existing wall such that the downwardly oriented lip catches a leading edge of the existing flooring and exerts an equivalent opposite force against the leading edge of the existing flooring away from the existing wall.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
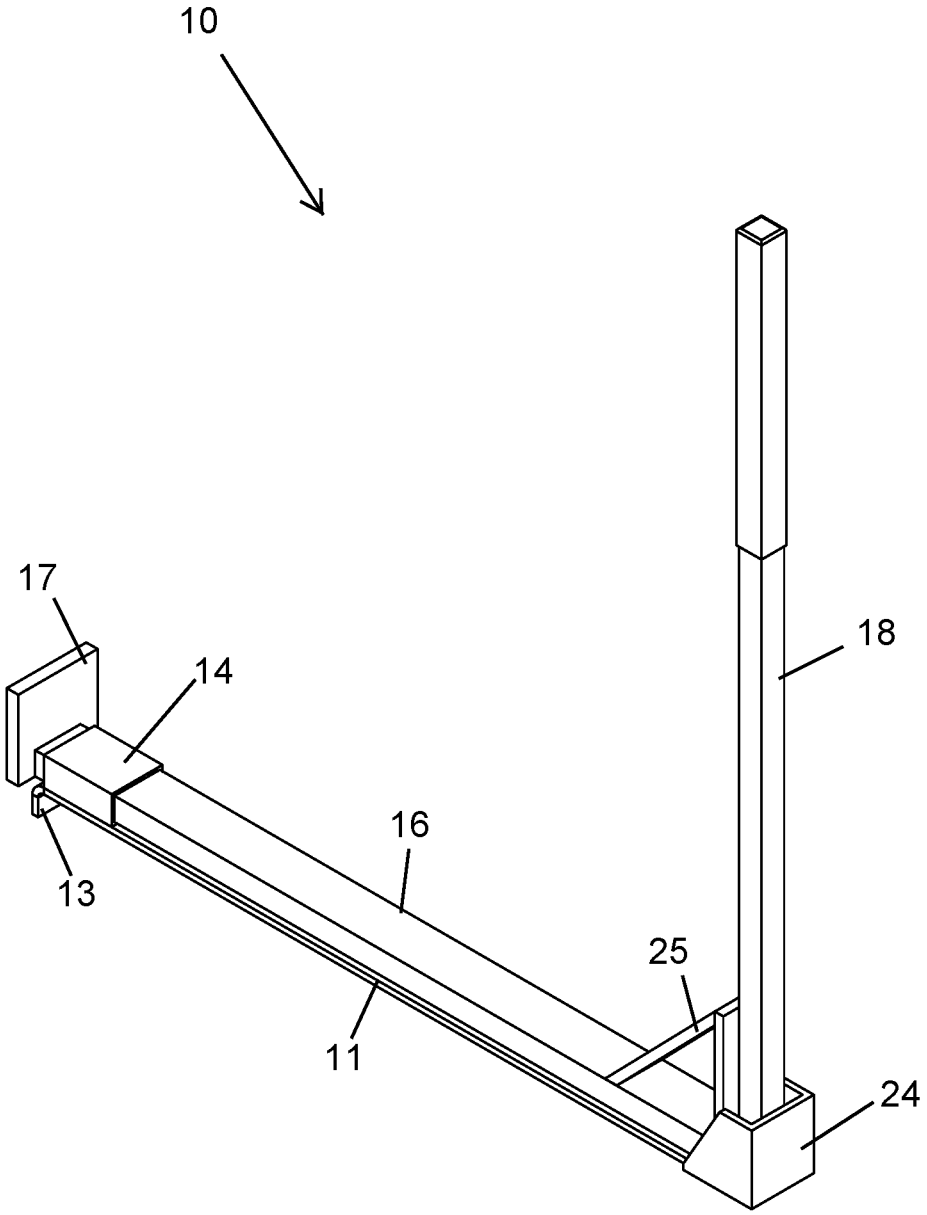
FIG. 1 is a perspective view of a wood flooring adjustment and assembly tool at a retracted, equilibrium position, in accordance with a non-limiting exemplary embodiment.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about" means approximately or nearly and in the context of a numerical value or range set forth means±15% of the numerical.

If used herein, "substantially" means largely if not wholly that which is specified but so close that the difference is insignificant.

Figure 2:
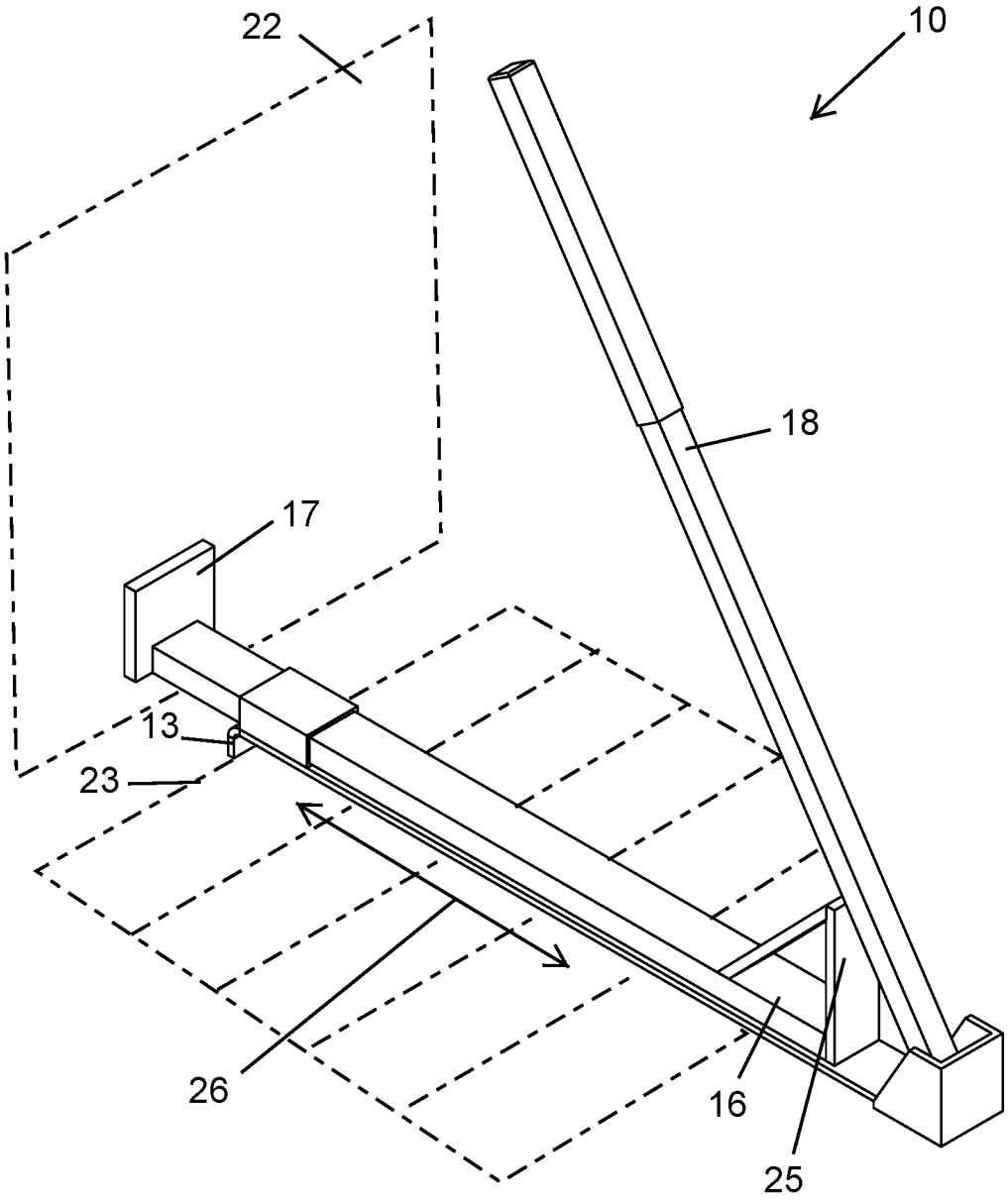
FIG. 2 is a perspective view of the wood flooring adjustment and assembly tool at an extended, tensioned position.
Figure 3:
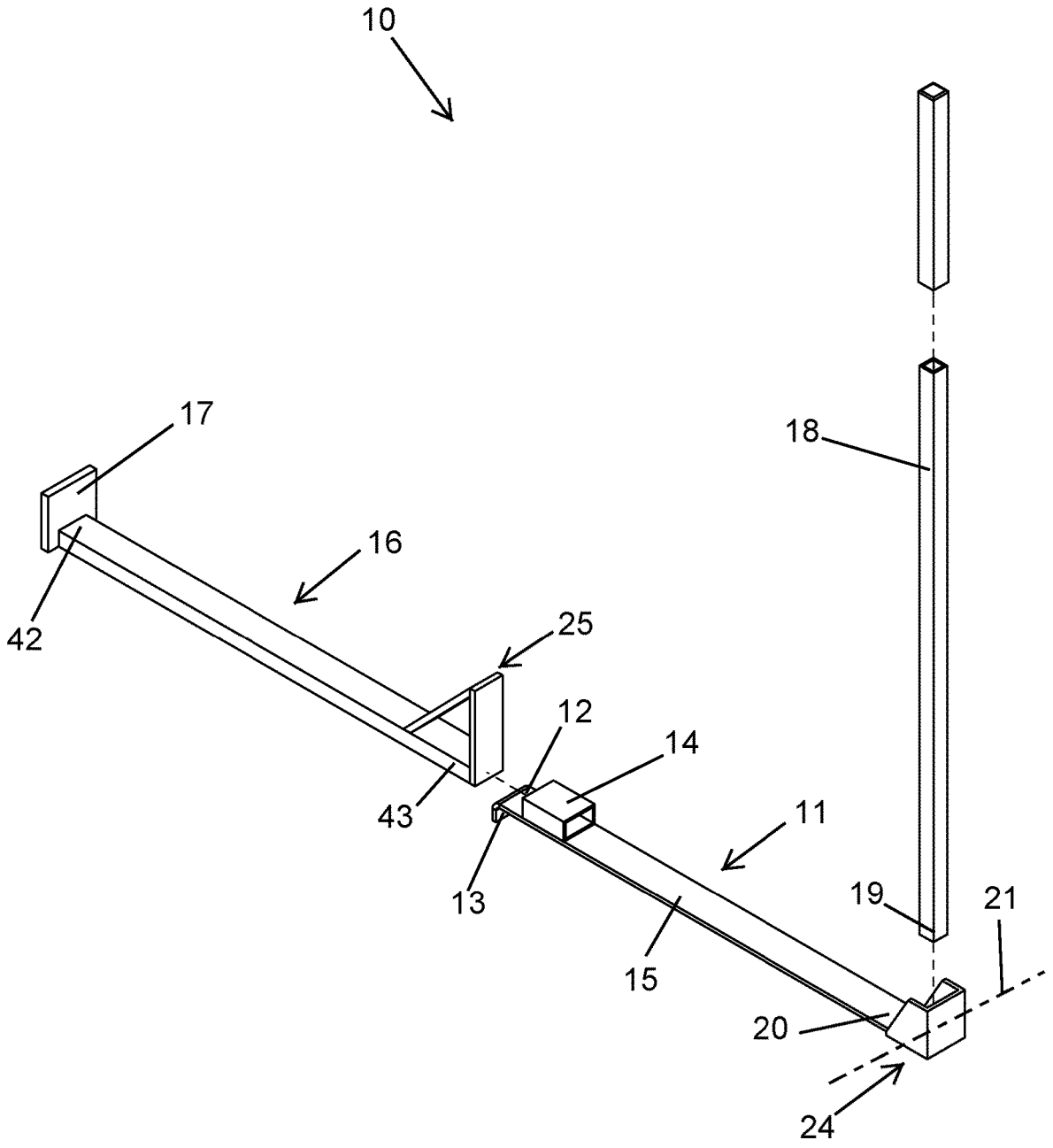
FIG. 3 is an exploded view of the wood flooring adjustment and assembly tool shown in FIG. 1.
Figure 4:
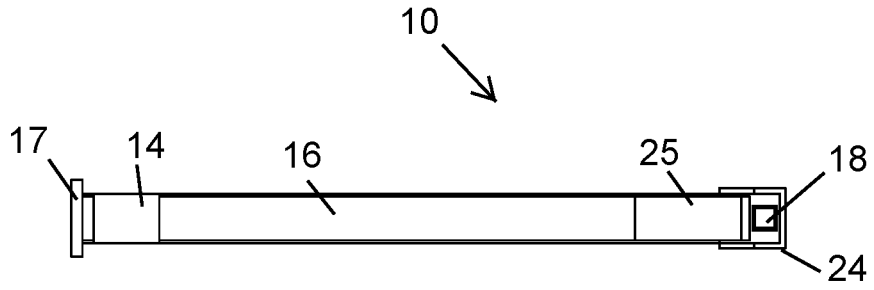
FIG. 4 is a top plan view of the wood flooring adjustment and assembly tool shown in FIG. 1.
Figure 5:
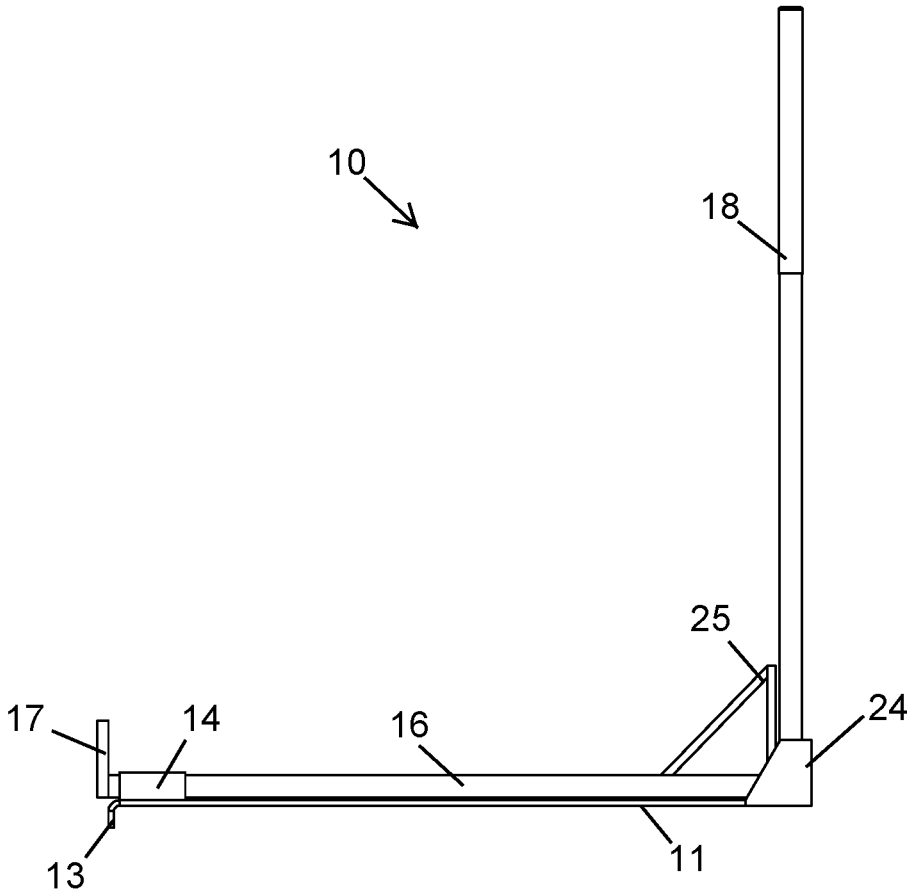
FIG. 5 is a side elevational view of the wood flooring adjustment and assembly tool shown in FIG. 1.
Figure 6:
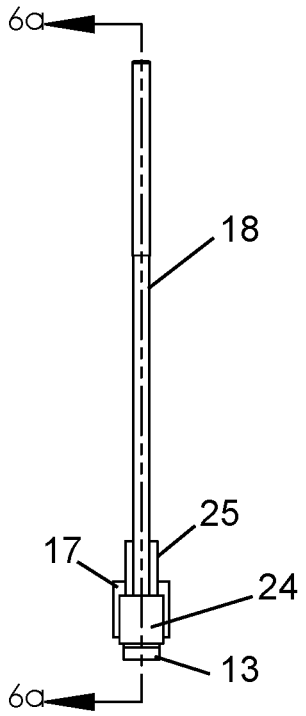
FIG. 6 is a front elevational view of the wood flooring adjustment and assembly tool shown in FIG. 1; and FIG. **6*a* is a cross-sectional view taken along line 6*a*-6*a* in FIG. 6**.
Figure 6A:
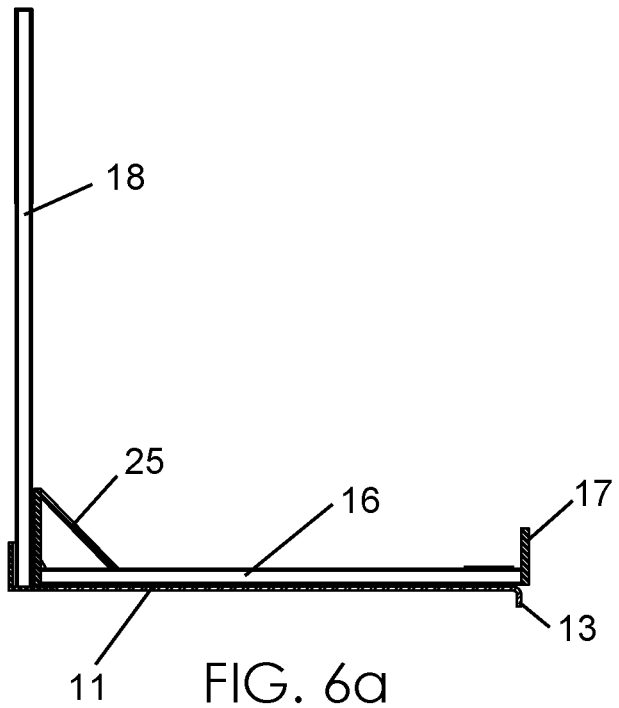

A non-limiting exemplary embodiment(s) of the present disclosure is referred to generally in FIGS. 1-6*a* and is/are intended to provide a manually-operated, wood flooring adjustment and assembly tool 10 for use in the installation of tongue-and-groove, hardwood flooring. Working quickly to ensure that laid flooring boards have a tight fit with no gaps, or damage or marring of the wood, the wood flooring adjustment and assembly tool 10 appeals to anyone who installs hardwood flooring—flooring contractors, all-around handymen, and do-it-yourself householders. It should be understood that the exemplary embodiment(s) may be used to install a variety of wood floor types, and should not be limited to any particular wood floor types described herein.

The non-limiting exemplary embodiment(s) is/are referred to generally in FIGS. 1-6*a* and is/are intended to provide a wood flooring adjustment and assembly tool 10 for use during installation of tongue-and-groove flooring. The wood flooring adjustment and assembly tool 10 includes a stationary flat bar 11 having a distal end 12 provided with a downwardly oriented lip 13, a guide 14 statically attached to a top surface 15 of the flat bar 11 and located proximally of the downwardly oriented lip 13, a dynamic bar 16 slidably positioned through the guide 14 and linearly reciprocated along the stationary flat bar 11 wherein the dynamic bar 16 has a plate 17 affixed to a distal end 42 thereof, and a lever 18 having a bottom end 19 pivotally positioned at a proximal end 20 of the stationary flat bar 11 and directly abutted against a proximal end 20 of the dynamic bar 16. Such a lever 18 is pivotal about a fulcrum axis 21 registered orthogonal to the proximal end 20 of the stationary flat bar 11. Notably, the downwardly oriented lip 13 is registered orthogonal to a longitudinal length of the dynamic bar 16 and parallel to the flat bar 11. Advantageously, when the bottom end 19 of the lever 18 is articulated towards the existing wall 22, the lever 18 exerts a force on the dynamic bar 16 and thereby urges the flat plate 17 towards and against the existing wall 22 such that the downwardly oriented lip 13 catches a leading edge 23 of the existing flooring and exerts an equivalent opposite force against the leading edge 23 of the existing flooring away from the existing wall 22.

In a non-limiting exemplary embodiment, the stationary flat bar 11 has a substantially smooth top surface 15 and includes a three-sided, U-shaped bracket 24 fixedly mated to the proximal end 20 thereof and abutted against the bottom end 19 of the lever 18 during articulation of the lever 18.

In a non-limiting exemplary embodiment, the dynamic bar 16 includes a two-side, V-shaped bracket 25 statically coupled to the proximal end 43 thereof.

In a non-limiting exemplary embodiment, the dynamic bar 16 reciprocates along a bi-directional linear path 26 registered substantially parallel to a longitudinal length of the stationary flat bar 11.

In a non-limiting exemplary embodiment, the plate 17 is oriented orthogonal to the bi-directional linear path 26.

In a non-limiting exemplary embodiment, the V-shaped bracket 25 extends upwardly and away from the dynamic bar 16.

In a non-limiting exemplary embodiment, the lever 18 has a linear longitudinal length and is disengaged from the dynamic bar 16 as well as the stationary flat bar 11 during non-operating conditions. Such a lever 18 is oriented perpendicular to the stationary flat bar 11 when the dynamic bar 16 is retracted to an equilibrium position during non-operating conditions.

In a non-limiting exemplary embodiment, the dynamic bar 16 lays on top of the stationary flat bar 11 and substantially parallel thereto.

The present disclosure further includes a method of utilizing a wood flooring adjustment and assembly tool 10 during installation of tongue-and-groove flooring. Such a method includes the steps of: providing a stationary flat bar 11 including a distal end 12 having a downwardly oriented lip 13; providing and statically attaching a guide 14 to a top surface 15 of the flat bar 11 such that the guide 14 is located proximally of the downwardly oriented lip 13; and providing and slidably positioning a dynamic bar 16 through the guide 14 such that the dynamic bar 16 is linearly reciprocated along the stationary flat bar 11 wherein the dynamic bar 16 has a plate 17 affixed to a distal end 12 thereof. Notably, the downwardly oriented lip 13 is registered orthogonal to a longitudinal length of the dynamic bar 16 and parallel to the flat bar 11.

The method further includes the steps of: providing and pivotally positioning a bottom end 19 of a lever 18 at a proximal end 20 of the stationary flat bar 11 such that the bottom end 19 is directly abutted against a proximal end 20 of the dynamic bar 16; pivoting the lever 18 about a fulcrum axis 21 registered orthogonal to the proximal end 20 of the stationary flat bar 11 such that the bottom end 19 of the lever 18 is articulated towards the existing wall 22; and the lever 18 exerting a force on the dynamic bar 16 thereby urging the flat plate 17 towards and against the existing wall 22 such that the downwardly oriented lip 13 catches a leading edge 23 of the existing flooring and exerts an equivalent opposite force against the leading edge 23 of the existing flooring away from the existing wall 22.

Referring to FIGS. 1-6*a* in general, in a non-limiting exemplary embodiment(s), a lever 18-operated device operates in a horizontal plane between the wall 22 and the laid floorboards to press the floorboards together into a tight, clean, gap-free fit.

In a non-limiting exemplary embodiment, the tool 10 can be fabricated in 1-inch by 2-inch square steel tubing and flat, tooled steel bar. Viewed from the top, the tool 10 may be T-shaped. The top of the "T" is 6 inches in width, and is the part of the tool 10 that rests against the wall 22. The long part of the "T", which measures 15 inches in length by 2 inches in width, extends outward along the floorboards from the wall 22 at an angle of 90 degrees. The long part of the "T" configuration just described, and fabricated in square steel tubing, fits into and onto a 16¼-inch flat steel bar "carriage" which is tooled with a 90-degree upper stop at the outer end; two welded strap-brackets which hold the square tubing of the "T" aligned within them; and a downward-oriented, 90-degree, ½-inch lip 13 or flange on the inner end. Either the outer, 90-degree upper stop—which measures 2¼ inches in height—or the outer strap-bracket—may be used as a pivot-point for a 30-inch lever 18. This lever 18 may be fabricated in 1-inch square steel tube. When pushed forward toward the wall 22, this lever 18 exerts force on the squared-tubing "T", pushing the top of the "T" toward and against the wall 22 as the square steel tubing slides forward within its flat-bar channel; and exerts an equivalent though opposite force on the flat steel bar, pushing it away from the wall 22.

The ½-inch, 90-degree, downward-oriented lip 13 at the end of the steel bar nearest the wall 22 has been set against the edge of the flooring board nearest the wall 22—and when the tool 10 has been properly positioned, and the lever 18 is pushed toward the wall 22, this lip 13 pulls away from the wall 22, forcing the flooring boards against one another until they are tight and fully seated. The tool 10 is used at several points along the wall 22 once the floorboards have been laid to ensure a tight, gap-free installation and fit.

A vast improvement over the conventional method of seating flooring boards with a crowbar for prying and a 2×4 for a fulcrum, tool 10 presents itself as exceptionally clever 18 in conception, thoughtful in design, and effective in action. Taking advantage of mechanical leverage, the tool 10 permits a single worker to quickly, neatly, and consistently ensure that laid floorboards were properly seated and tightened—and do so with a minimum of labor, and no attendant damage or marring of the adjacent wall 22.

Tool 10 provides years of trouble-free service, and should find an enthusiastic reception among flooring installers and contractors, as well as among all-around handymen and ambitious household do-it-yourselfers.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. § 1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A wood flooring adjustment and assembly tool for use during installation of tongue-and-groove flooring, said wood flooring adjustment and assembly tool comprising:

a stationary flat bar having a distal end provided with a downwardly oriented lip;

a guide statically attached to a top surface of said flat bar and located proximally of said downwardly oriented lip;

a dynamic bar slidably positioned through said guide and linearly reciprocated along said stationary flat bar, said dynamic bar having a plate affixed to a distal end thereof; and a lever having a bottom end pivotally positioned at a proximal end of said stationary flat bar and directly abutted against a proximal end of said dynamic bar when in an operational state, said lever being pivotal about a fulcrum axis registered orthogonal to said proximal end of said stationary flat bar;

wherein, when said bottom end of said lever is articulated towards the existing wall, said lever exerts a force on said dynamic bar and thereby urges said flat plate towards and against the existing wall such that said downwardly oriented lip catches a leading edge of the existing flooring and exerts an equivalent opposite force against the leading edge of the existing flooring away from the existing wall;

wherein said stationary flat bar has a substantially smooth top surface and comprises: a three-sided, U-shaped bracket fixedly mated to said proximal end thereof and abutted against said bottom end of said lever during articulation of said lever;

wherein said dynamic bar includes a two-side, V-shaped bracket statically coupled to said proximal end thereof.

2. The wood flooring adjustment and assembly tool of claim 1, wherein said dynamic bar reciprocates along a bi-directional linear path registered substantially parallel to a longitudinal length of said stationary flat bar.

3. The wood flooring adjustment and assembly tool of claim 2, wherein said plate is oriented orthogonal to the bi-directional linear path.

4. The wood flooring adjustment and assembly tool of claim 3, wherein said V-shaped bracket extends upwardly and away from said dynamic bar.

5. The wood flooring adjustment and assembly tool of claim 4, wherein said lever has a linear longitudinal length and is disengaged from said dynamic bar as well as said stationary flat bar during non-operating conditions, said lever being oriented perpendicular to said stationary flat bar when said dynamic bar is retracted to an equilibrium position during non-operating conditions.

6. The wood flooring adjustment and assembly tool of claim 5, wherein said dynamic bar lays on top of said stationary flat bar and substantially parallel thereto.

7. A wood flooring adjustment and assembly tool for use during installation of tongue-and-groove flooring, said wood flooring adjustment and assembly tool comprising:

a stationary flat bar having a distal end provided with a downwardly oriented lip;

a guide statically attached to a top surface of said flat bar and located proximally of said downwardly oriented lip;

a dynamic bar slidably positioned through said guide and linearly reciprocated along said stationary flat bar, said dynamic bar having a plate affixed to a distal end thereof; and a lever having a bottom end pivotally positioned at a proximal end of said stationary flat bar and directly abutted against a proximal end of said dynamic bar when in an operational state, said lever being pivotal about a fulcrum axis registered orthogonal to said proximal end of said stationary flat bar;

wherein, when said bottom end of said lever is articulated towards the existing wall, said lever exerts a force on said dynamic bar and thereby urges said flat plate towards and against the existing wall such that said downwardly oriented lip catches a leading edge of the existing flooring and exerts an equivalent opposite force against the leading edge of the existing flooring away from the existing wall;

wherein said downwardly oriented lip is registered orthogonal to a longitudinal length of said dynamic bar and parallel to said flat bar;

wherein said stationary flat bar has a substantially smooth top surface and comprises: a three-sided, U-shaped bracket fixedly mated to said proximal end thereof and abutted against said bottom end of said lever during articulation of said lever;

wherein said dynamic bar includes a two-side, V-shaped bracket statically coupled to said proximal end thereof.

8. The wood flooring adjustment and assembly tool of claim 7, wherein said dynamic bar reciprocates along a bi-directional linear path registered substantially parallel to a longitudinal length of said stationary flat bar.

9. The wood flooring adjustment and assembly tool of claim 8, wherein said plate is oriented orthogonal to the bi-directional linear path.

10. The wood flooring adjustment and assembly tool of claim 9, wherein said V-shaped bracket extends upwardly and away from said dynamic bar.

11. The wood flooring adjustment and assembly tool of claim 10, wherein said lever has a linear longitudinal length and is disengaged from said dynamic bar as well as said stationary flat bar during non-operating conditions, said lever being oriented perpendicular to said stationary flat bar when said dynamic bar is retracted to an equilibrium position during non-operating conditions.

12. The wood flooring adjustment and assembly tool of claim 11, wherein said dynamic bar lays on top of said stationary flat bar and substantially parallel thereto.

13. A method of utilizing a wood flooring adjustment and assembly tool during installation of tongue-and-groove flooring, said method comprising the steps of:

providing a stationary flat bar including a distal end having a downwardly oriented lip;

providing and statically attaching a guide to a top surface of said flat bar such that said guide is located proximally of said downwardly oriented lip;

providing and slidably positioning a dynamic bar through said guide such that said dynamic bar is linearly reciprocated along said stationary flat bar, said dynamic bar having a plate affixed to a distal end thereof, wherein said downwardly oriented lip is registered orthogonal to a longitudinal length of said dynamic bar and parallel to said flat bar;

providing and pivotally positioning a bottom end of a lever at a proximal end of said stationary flat bar such that said bottom end is directly abutted against a proximal end of said dynamic bar when in an operational state;

pivoting said lever about a fulcrum axis registered orthogonal to said proximal end of said stationary flat bar such that said bottom end of said lever is articulated towards the existing wall; and said lever exerting a force on said dynamic bar thereby urging said flat plate towards and against the existing wall such that said downwardly oriented lip catches a leading edge of the existing flooring and exerts an equivalent opposite force against the leading edge of the existing flooring away from the existing wall;

wherein said stationary flat bar has a substantially smooth top surface and comprises: a three-sided, U-shaped bracket fixedly mated to said proximal end thereof and abutted against said bottom end of said lever during articulation of said lever;

wherein said dynamic bar includes a two-side, V-shaped bracket statically coupled to said proximal end thereof.

* * * * *